US006896496B2

(12) United States Patent
Haller et al.

(10) Patent No.: US 6,896,496 B2
(45) Date of Patent: May 24, 2005

(54) COMPRESSOR ASSEMBLY HAVING CRANKCASE

(75) Inventors: David K. Haller, Adrian, MI (US); Robin G. Skinner, Tecumseh, MI (US); Richard C. Haney, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/657,311

(22) Filed: Sep. 8, 2003

(65) Prior Publication Data

US 2004/0057848 A1 Mar. 25, 2004

Related U.S. Application Data

(60) Provisional application No. 60/412,768, filed on Sep. 23, 2002.

(51) Int. Cl.[7] ..... F01C 1/02

(52) U.S. Cl. ..... 418/55.1; 418/55.6; 418/94; 418/97; 418/270; 184/6.17

(58) Field of Search ..... 418/55.1, 55.6, 418/270, DIG. 1, 94, 97; 184/6.17

(56) References Cited

U.S. PATENT DOCUMENTS

| | | | | |
|---|---|---|---|---|
| 2,661,172 A | | 12/1953 | Needham | |
| 3,039,725 A | | 6/1962 | Kerley, Jr. | |
| RE25,569 E | | 5/1964 | Coron et al. | |
| 3,145,960 A | | 8/1964 | Langdon | |
| 3,749,340 A | | 7/1973 | Williams et al. | |
| 3,785,167 A | | 1/1974 | Sahs | |
| 4,089,613 A | | 5/1978 | Babbitt, Jr. | |
| 4,244,680 A | | 1/1981 | Ishizuka et al. | |
| 4,389,171 A | | 6/1983 | Eber et al. | |
| 4,416,594 A | | 11/1983 | Ichikawa | |
| 4,497,615 A | | 2/1985 | Griffith | |
| 4,518,276 A | | 5/1985 | Mitchell | |
| 4,552,518 A | | 11/1985 | Utter | |
| 4,557,677 A | | 12/1985 | Hasegawa | |
| 4,685,188 A | | 8/1987 | Goy | |
| 4,767,293 A | | 8/1988 | Caillat et al. | |
| 4,792,288 A | | 12/1988 | Gromoll et al. | |
| 4,818,198 A | | 4/1989 | Tamura et al. | |
| 4,877,382 A | | 10/1989 | Caillat et al. | |
| 4,886,435 A | * | 12/1989 | Sawai et al. | 418/94 |
| 4,992,033 A | | 2/1991 | Caillat et al. | |
| 5,012,896 A | | 5/1991 | Da Costa | |
| 5,055,010 A | | 10/1991 | Logan | |

(Continued)

FOREIGN PATENT DOCUMENTS

| | | | | |
|---|---|---|---|---|
| JP | 61087994 | | 5/1986 | |
| JP | 61112795 A | * | 5/1986 | F04C/18/02 |
| JP | 402061382 A | | 3/1990 | |
| JP | 03054391 A | * | 3/1991 | F04C/29/02 |
| JP | 407259764 A | | 10/1995 | |
| JP | 410148191 A | | 6/1998 | |
| JP | 2001020881 A | | 1/2001 | |
| JP | 2002021729 A | | 1/2002 | |
| JP | 2002098056 A | | 4/2002 | |
| JP | 2002122083 A | * | 4/2002 | F04C/18/02 |

*Primary Examiner*—Theresa Trieu
(74) *Attorney, Agent, or Firm*—Baker & Daniels

(57) ABSTRACT

A scroll compressor having crankcase with an integral shroud. The shroud includes an aperture and defines a partial enclosure. A counterweight mounted on the shaft of the compressor is disposed within the partial enclosure defined by the shroud. The aperture is positioned above the shaft and the shroud shields an oil sump within the compressor housing from the fanning action of the counterweight. A scroll compressor having a baffle extending from an inlet to the compressor housing to an inlet of the working space of the compressor is also provided. The baffle is secured to the crankcase of the compressor and may include an opening that functions as an oil stripper.

14 Claims, 14 Drawing Sheets

U.S. PATENT DOCUMENTS 5,062,779 A 11/1991 Da Costa
5,110,268 A 5/1992 Sakurai et al.
5,114,322 A 5/1992 Caillat et al.
5,137,437 A 8/1992 Machida et al.
5,176,506 A 1/1993 Siebel
5,211,031 A 5/1993 Murayama et al.
RE34,297 E 6/1993 Elson
5,219,281 A 6/1993 Caillat et al.
5,222,885 A 6/1993 Cooksey
5,224,845 A 7/1993 Mangyo et al.
5,240,391 A 8/1993 Ramshankar et al.
5,247,738 A 9/1993 Yoshii
5,312,234 A 5/1994 Yoshii
5,345,785 A 9/1994 Sekigami et al.
5,345,970 A 9/1994 Leyderman et al.
5,346,375 A 9/1994 Akiyama et al.
5,348,455 A 9/1994 Herrick et al.
5,370,156 A 12/1994 Peracchio et al.
5,391,066 A 2/1995 Sawai et al.
5,427,511 A 6/1995 Caillat et al.
5,474,433 A 12/1995 Chang et al.
5,487,648 A 1/1996 Alfano et al.
5,522,715 A 6/1996 Watanabe et al.
5,531,577 A 7/1996 Hayase et al.
5,533,875 A 7/1996 Crum et al.
5,579,651 A 12/1996 Sugiyama et al.
5,580,233 A 12/1996 Wakana et al.
5,597,293 A 1/1997 Bushnell et al.
5,597,296 A 1/1997 Akazawa et al.
5,634,781 A 6/1997 Yoshida et al.
5,645,408 A 7/1997 Fujio et al.
5,660,539 A 8/1997 Matsunaga et al.
5,683,237 A 11/1997 Hagiwara et al.
5,695,326 A 12/1997 Oka et al.
5,716,202 A 2/1998 Koyama et al.
5,720,601 A 2/1998 Tark et al.
5,745,992 A 5/1998 Caillat et al.
5,752,688 A 5/1998 Campbell et al.
5,769,126 A 6/1998 Cho
5,772,411 A 6/1998 Crum et al.
5,772,416 A 6/1998 Caillat et al.
5,775,894 A 7/1998 Kosco, Jr.
5,810,572 A 9/1998 Yamamoto et al.
5,829,959 A 11/1998 Tsubono et al.
5,863,190 A 1/1999 Yamamoto et al.
5,913,892 A 6/1999 Kwon
5,931,649 A 8/1999 Caillat et al.
5,931,650 A 8/1999 Yasu et al.
5,947,709 A 9/1999 Koyama et al.
5,964,581 A 10/1999 Iizuka et al.
6,000,917 A 12/1999 Smerud et al.
6,011,336 A 1/2000 Mathis et al.
6,027,321 A 2/2000 Shim et al.
6,039,551 A 3/2000 Takeuchi et al.
6,050,794 A 4/2000 Noboru et al.
6,056,523 A 5/2000 Won et al.
6,106,254 A 8/2000 Hirooka et al.
6,132,191 A 10/2000 Hugenroth et al.
6,139,291 A 10/2000 Perevozchikov
6,156,106 A 12/2000 Kamata
6,162,035 A 12/2000 Hayano et al.
6,167,719 B1 1/2001 Yakumaru et al.
6,171,076 B1 1/2001 Gannaway
6,179,589 B1 1/2001 Bass et al.
6,186,753 B1 2/2001 Hugenroth et al.
6,224,356 B1 5/2001 Dewar et al.
6,227,830 B1 5/2001 Fields et al.
6,247,910 B1 6/2001 Yokoyama
6,261,073 B1 7/2001 Kumazawa
6,264,446 B1 7/2001 Rajendran et al.
6,280,154 B1 8/2001 Clendenin et al.
6,299,423 B1 10/2001 Perevozchikov
6,305,912 B1 10/2001 Svendsen et al.
6,402,485 B2 6/2002 Hong et al.
2001/0006603 A1 7/2001 Hong et al.
2001/0055536 A1 12/2001 Bernardi et al.

* cited by examiner

COMPRESSOR ASSEMBLY HAVING CRANKCASE

CROSS REFERENCE TO RELATED APPLICATIONS

This application claims priority under 35 U.S.C. 119(e) of U.S. provisional patent application Ser. No. 60/412,768 filed on Sep. 23, 2002 entitled COMPRESSOR ASSEMBLY the disclosure of which is hereby incorporated by reference.

BACKGROUND OF THE INVENTION

1. Field of the Invention

The present invention relates to compressor assemblies and, more particularly, to crankcases for use with scroll compressor assemblies.

2. Description of the Related Art

Conventional scroll compressors include mutually engaged fixed and orbiting scroll members wherein a crankcase is disposed on the backside of the orbiting scroll member between the orbiting scroll member and a motor. Conventional crankcases also include a bearing for rotatably supporting a shaft which extends between the motor and the orbiting scroll. A counterweight is typically mounted on the shaft to counterbalance the eccentric load placed on the shaft by the orbiting scroll. Lubricating oil is often collected in a sump defined by the compressor housing and refrigerant entering the compressor housing oftentimes contains small quantities of oil. The lubricating oil must be provided to the surfaces for which lubrication is desired while avoiding the excess accumulation of oil in locations where it may degrade the performance of the compressor. Although various methods of controlling and managing the movement of oil within compressors have been developed, improvements are desirable.

SUMMARY OF THE INVENTION

The present invention provides an improved crankcase for a scroll compressor which includes a shield portion partially enclosing a length of the shaft between a thrust surface engageable with the orbiting scroll member and a bearing support portion of the crankcase. A baffle member is also attached to the crankcase. The shield portion of the crankcase and the baffle member attached to the crankcase facilitate the control of oil movement within the compressor assembly.

The invention comprises, in one form thereof, a compressor assembly including a housing defining an interior plenum and having an inlet opening, a stationary scroll member fixed within the housing and an orbiting scroll member disposed within the housing and engaged with the stationary scroll member. An oil sump is disposed within the interior plenum. A shaft, rotatable about a shaft axis, is operably coupled with the orbiting scroll member. A motor is also operably coupled with the shaft. A crankcase is fixed within the housing and is disposed between the orbiting scroll member and the motor. The crankcase has a thrust surface which is engageable with the orbiting scroll member and defines a first opening. The crankcase also includes a bearing support portion which defines a second opening. The shaft freely extends through the first opening and extends through and is bearingly supported at the second opening. The crankcase has a shield portion which extends from proximate the first opening to proximate the second opening and which defines a partial enclosure for the shaft between the first opening and the second opening. The shield portion defines an aperture providing fluid communication between the interior plenum and the partial enclosure. The aperture axially extending from proximate the first opening to proximate the second opening. The shield portion circumferentially extends about the shaft along an arc of at least 180 degrees and is spaced radially outwardly of the shaft. A sheet-like baffle member is secured to the crankcase and positioned proximate the inlet opening.

The invention comprises, in another form thereof, a compressor assembly including a housing defining an interior plenum, a stationary scroll member fixed within the housing and an orbiting scroll member disposed within the housing and engaged with the stationary scroll member. A shaft, rotatable about a shaft axis, is operably coupled with the orbiting scroll member. A motor is also operably coupled with the shaft. A crankcase is disposed between the motor and the orbiting scroll member and includes a thrust surface which is engageable with the orbiting scroll member and defines a first opening. The crankcase also includes a bearing support portion defining a second opening. The shaft extends freely through the first opening and extends through and is bearingly supported at the second opening. The crankcase also includes a plurality of legs extending from proximate the thrust surface in a direction substantially parallel to the shaft axis wherein the legs have distal ends engageable with the motor. The crankcase also has a shield portion extending from proximate the first opening to proximate the second opening and defining a partial enclosure for the shaft between the first opening and the second opening. The aperture provides fluid communication between the interior plenum and the partial enclosure and axially extends from proximate the first opening to proximate the second opening. The shield portion circumferentially extends about the shaft along an arc of at least 180 degrees and is spaced radially outwardly of the shaft and radially inwardly of the plurality of legs. A baffle member is secured to the crankcase and is at least partially disposed radially between the shield portion and the legs.

In alternative forms of the compressor assembly, a counterweight may be disposed on the shaft between the first and second openings within the partial enclosure. The baffle member may be positioned radially outwardly of the aperture defined by the shield portion. The aperture may be positioned at a height above the shaft axis. The crankcase may have an outer perimeter which defines a recess providing access to a working space between the fixed and orbiting scroll members wherein the baffle member is positioned adjacent the recess. The shield portion may extend circumferentially about the shaft through an arc of at least about 270 degrees.

An advantage of the present invention is that the use of a crankcase having a shield portion forming a partial enclosure around the shaft allows a counterweight to be disposed on the shaft within the partial enclosure. By positioning the aperture in the shield portion above the shaft, the counterweight may thereby be shielded from the oil sump. Thus, the counterweight will not impact the oil as it rotates and the fanning action of the counterweight will not agitate the oil in the sump and the open aperture allows refrigerant, at suction pressure when the motor and crankcase are positioned in the low pressure side of the compressor housing, to be communicated between the housing interior and the partial enclosure defined by the shield and through an opening in the thrust surface of the crankcase facing the rear of the orbiting scroll member.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
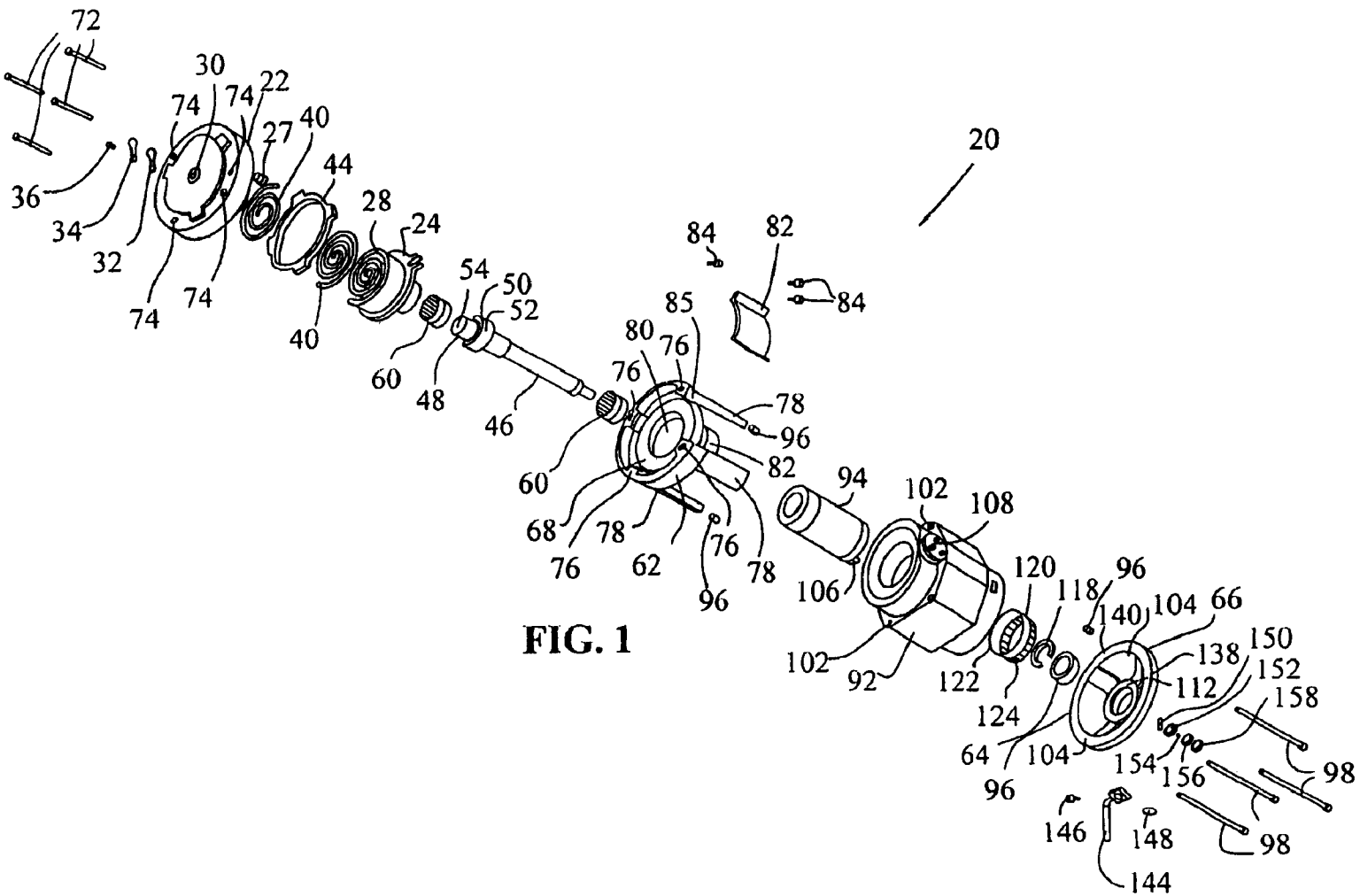
FIG. 1 is an exploded view of a scroll compressor in accordance with the present invention.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DESCRIPTION OF THE PRESENT INVENTION

In accordance with the present invention, a scroll compressor 20 is shown in an exploded view in FIG. 1. Scroll compressor 20 includes a fixed or stationary scroll member 22 which is engaged with an orbiting scroll member 24. Fixed and orbiting scroll members 22, 24 respectively include an involute wrap 26, 28. A refrigerant is compressed between scroll members 22, 24 in pockets which are formed between involute wraps 26, 28 and which migrate radially inwardly as scroll member 24 orbitally moves relative to fixed scroll member 22. The refrigerant enters the space between the scroll members at low pressure through inlet 23 (FIG. 4) located at the radially outer portion of the space formed between scroll members 22, 24 and is discharged at a relatively high pressure through a discharge port 30 located proximate the radial center of fixed scroll member 22. Scroll members 22, 24 each have carbon steel tip seals 40 mounted in recesses located in the distal tips of involute wraps 26, 28, for providing a seal between involute wraps 26, 28 and the base plate of the opposing scroll member.

A one-way valve allows compressed refrigerant to be discharged into a discharge chamber or plenum 38 and prevents compressed refrigerant located in discharge plenum 38 from reentering discharge port 30. The valve includes an exhaust valve leaf 32 which sealingly engages fixed scroll member 22 at discharge port 30 and an exhaust valve retainer 34. Valve leaf 32 is secured between fixed scroll member 22 and valve retainer 34. Valve retainer 34 has a bend at its distal end which allows valve leaf 32 to flex outwardly away from discharge port 30 when gas is compressed between scroll members 22, 24 and thereby permit the passage of high pressure gas into discharge plenum 38. Valve retainer 34 limits the extent to which valve leaf 32 may flex outwardly away from discharge port 30 to prevent damage from excessive flexing of valve leaf 32. A threaded fastener 36 secures valve retainer 34 and valve leaf 32 to fixed scroll member 22. An alternative valve that may be used with compressor 20 is described by Haller et al. in U.S. Provisional Patent Application Ser. No. 60/412,905 entitled COMPRESSOR HAVING DISCHARGE VALVE filed on Sep. 23, 2002 which is hereby incorporated herein by reference. Pressure relief valve 27 is positioned between scroll members 22, 24 to allow discharge pressure gas to be directed into the suction pressure inlet in the event of overpressurization.

An Oldham ring 44 is disposed between fixed scroll member 22 and orbiting scroll member 24 to control the relative motion between orbiting scroll member 24 and fixed scroll member 22. Orbiting scroll 24 is mounted on an eccentrically positioned extension 48 on shaft 46 and rotation of shaft 46 imparts a relative orbital movement between orbiting scroll 24 and fixed scroll 22. The use of shafts having eccentrically positioned extensions and Oldham rings to impart a relative orbital motion between scroll members of a compressor is well known to those having ordinary skill in the art.

A counterweight 50 (FIG. 1) includes a collar portion with an opening through which shaft 46 is inserted. Counterweight 50 is not shown in FIGS. 3 and 4. Counterweight 50 also includes a partially cylindrical wall 52 which eccentrically loads shaft 46 to counterbalance the eccentric loading of shaft 46 by orbiting scroll 24. Counterweight 50 is heat shrink fitted onto shaft 46 in the illustrated embodiment. Shaft 46 includes an internal passageway 54 extending the longitudinal length of shaft 46 and secondary passages 56 extending transversely from passageway 54 to the radially outer surface of shaft 46. Passageways 54, 56 communicate lubricating oil between oil sump 58, which is located in the suction pressure chamber of the compressor housing, and bearings rotatably engaging shaft 46.

Two roller bearings 60 are positioned on shaft 46 where shaft 46 respectively engages orbiting scroll 24 and crankcase 62. A ball bearing 64 is positioned near the opposite end of shaft 46 and is mounted within bearing support 66. Shaft 46 may be supported in a manner similar to that described by Haller et al. in U.S. patent application Ser. No. 09/964,241 filed Sep. 26, 2001 entitled SHAFT AXIAL COMPLIANCE MECHANISM and which is hereby incorporated herein by reference.

Crankcase 62 is secured to fixed scroll 22 with threaded fasteners 72 which pass through apertures 74 located in fixed scroll 22 and engage threaded bores 76 in crankcase 62. Crankcase 62 includes a thrust surface 68 which slidably engages orbiting scroll 24 and restricts movement of orbiting scroll 24 away from fixed scroll 22. Crankcase 62 also includes four legs 78 which secure the crankcase to stator 92 as described in greater detail below. Shaft 46 extends through opening 80 in crankcase 62. Crankcase 62 includes a shroud or shield portion 70 which is disposed between legs 78 in the lower portion of the horizontal compressor housing and partially encloses a space within which counterweight 50 rotates. Shroud 70 includes an opening or aperture 81 along its upper portion which permits the equalization of pressure between the space partially enclosed by shroud 70 and the remainder of the low pressure chamber or plenum 39 of compressor 20. Low pressure plenum 39 includes that space within compressor housing 88 located between orbiting scroll 24 and end cap 168 and receives the suction pressure refrigerant which is returned to compressor 20 through inlet tube 86.

Figure 4:
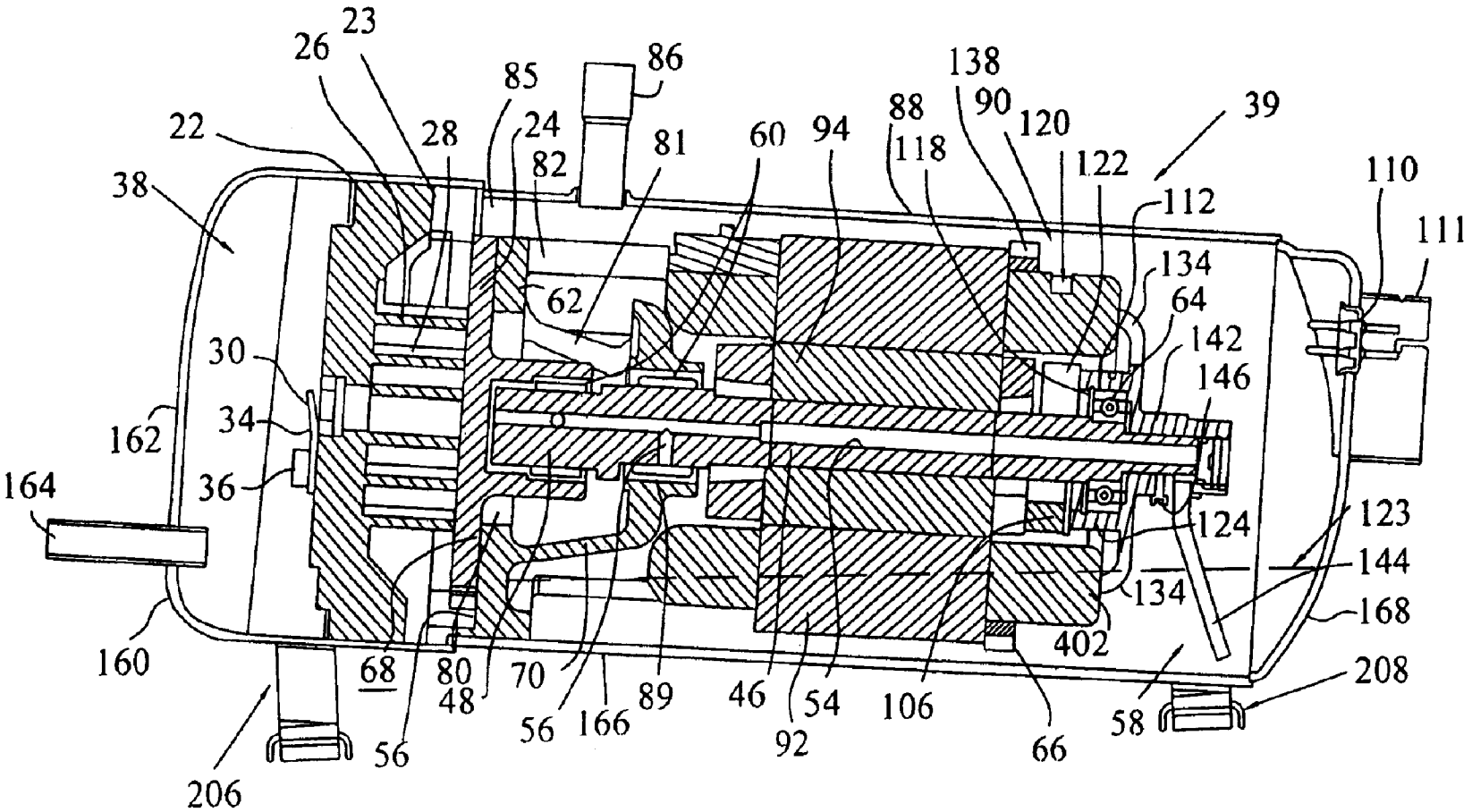
FIG. 4 is a sectional view of the compressor of FIG. 2 taken along line 4—4.

A suction baffle 82 (FIG. 1) is secured between two legs 78 using fasteners. The illustrated fasteners are socket head cap screws 84 but other fasteners such as self-tapping screws and other fastening methods may also be used to secure suction baffle 82. Suction baffle 82 is positioned proximate inlet tube 86 as best seen in FIG. 4. Refrigerant enters compressor housing 88 through inlet tube 86 and suction baffle 82 is positioned in the flow path of entering refrigerant to redirect the refrigerant along the outer perimeter of crankcase 62. The outer perimeter of crankcase 62 includes a recess 85 adjacent suction baffle 82 which defines a passage to inlet 23. Crankcase 62 includes a sleeve portion 89 in which roller bearing 60 is mounted for rotatably supporting shaft 46. Sleeve 89 is supported by shroud portion 70 opposite opening 80.

Figure 5:
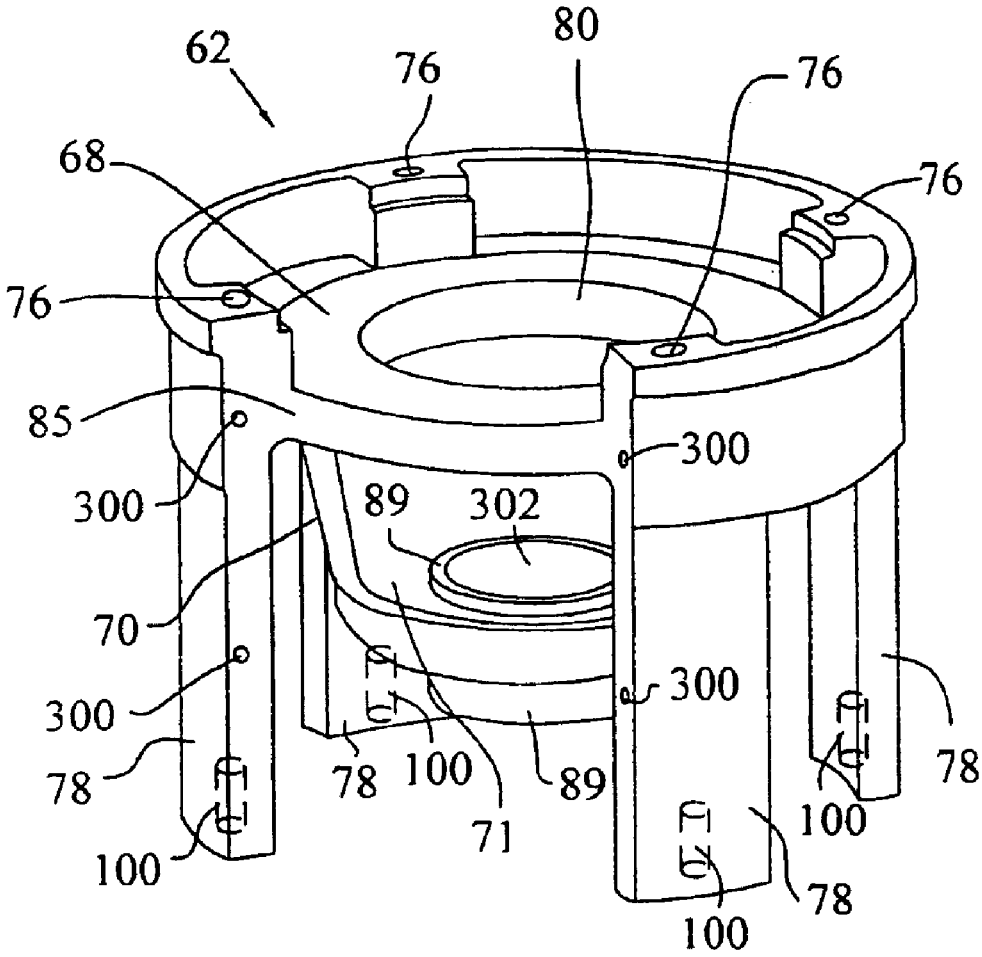
FIG. 5 is a perspective view of a first embodiment of a crankcase.
Figure 6:
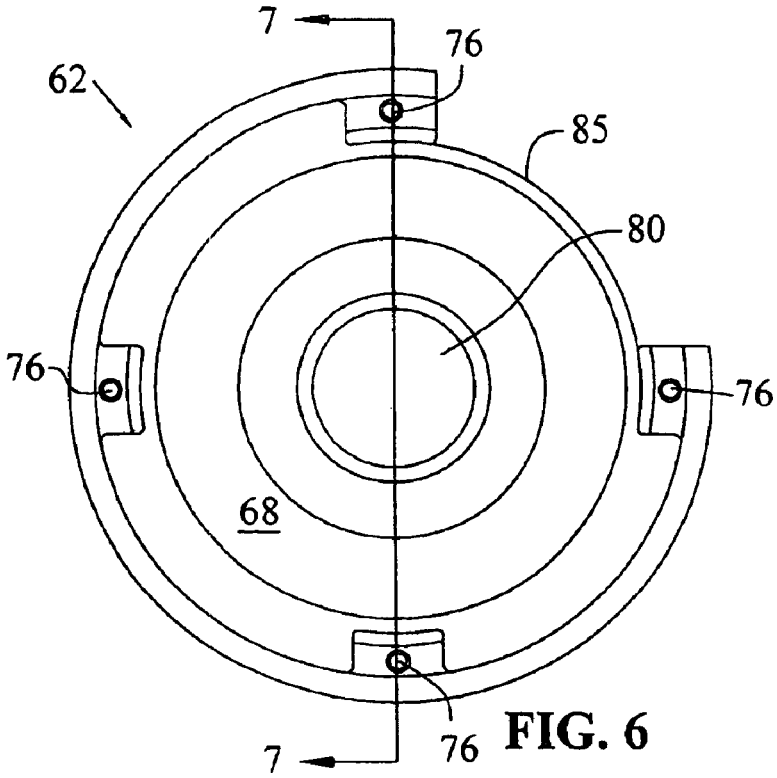
FIG. 6 is a side view of the crankcase of FIG. 5.
Figure 7:
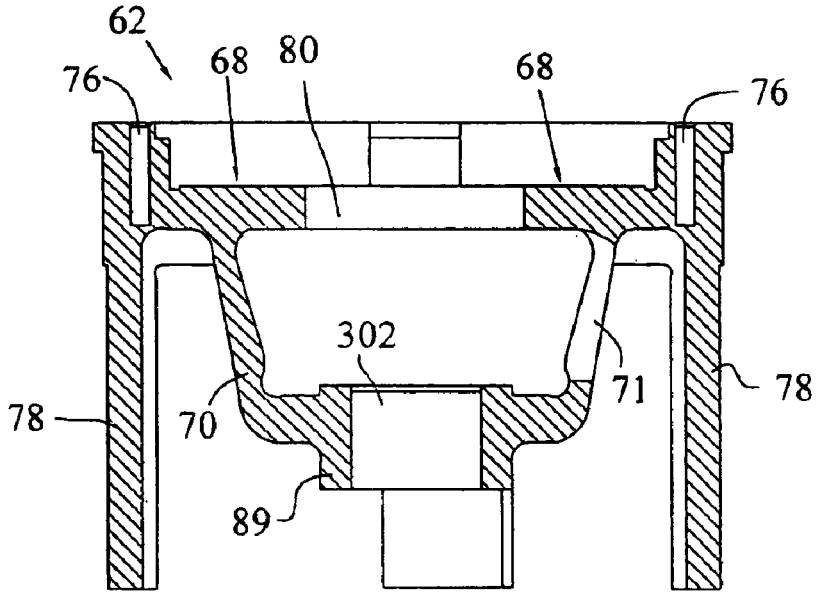
FIG. 7 is a cross sectional view taken along line 7—7 of FIG. 6.
Figure 8:
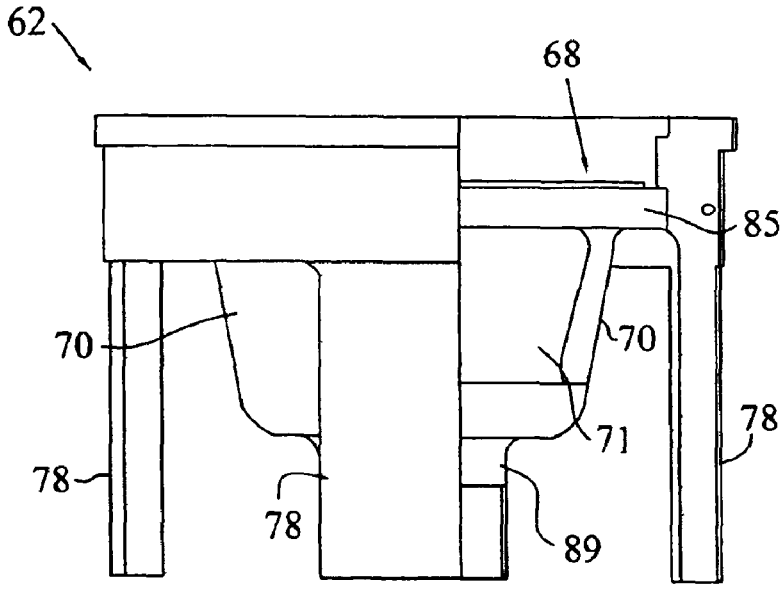
FIG. 8 is a side view of the crankcase of FIG. 5.
Figure 9:
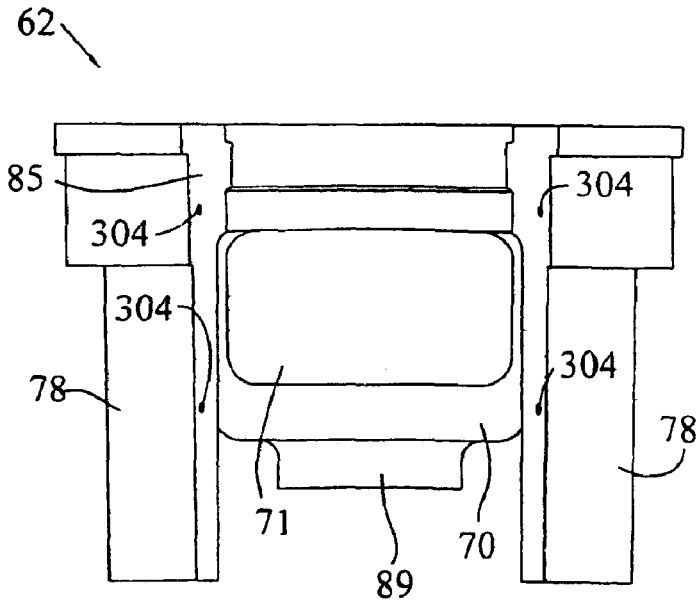
FIG. 9 is a top view of the crankcase of FIG. 5.
Figure 10:
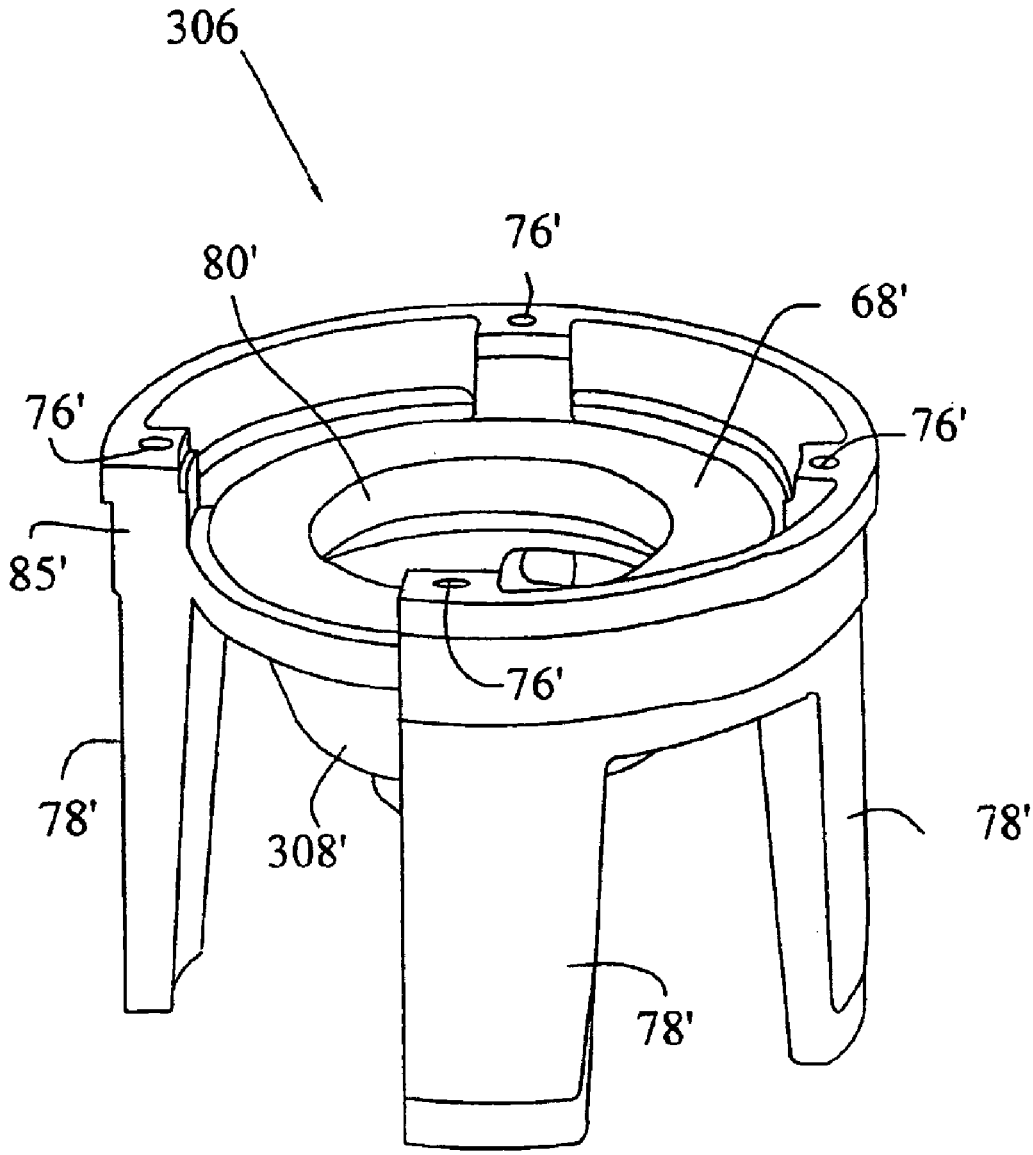
FIG. 10 is a perspective view of a second embodiment of a crankcase.
Figure 11:
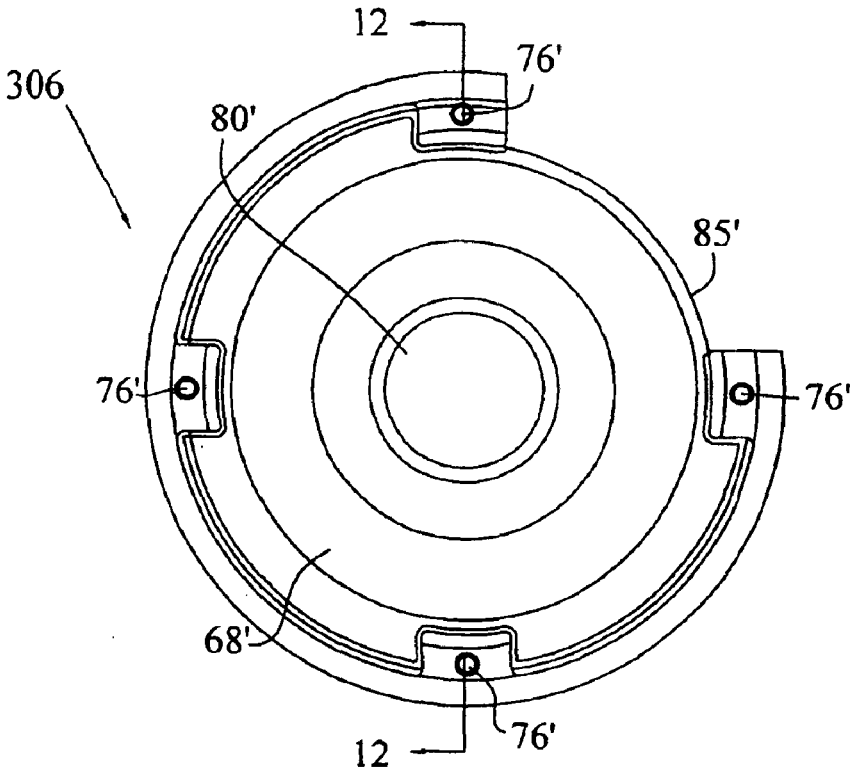
FIG. 11 is a side view of the crankcase of FIG. 10.
Figure 12:
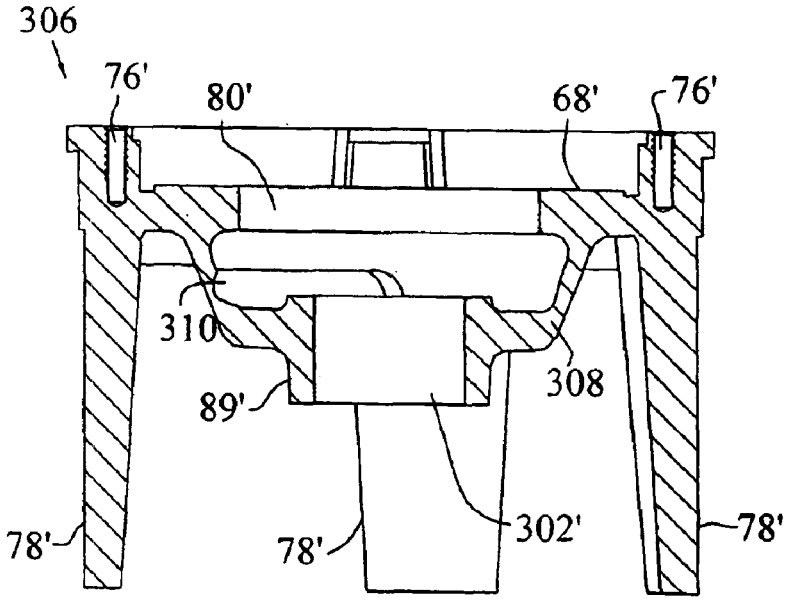
FIG. 12 is a cross sectional view taken along line 12—12 of FIG. 11.
Figure 13:
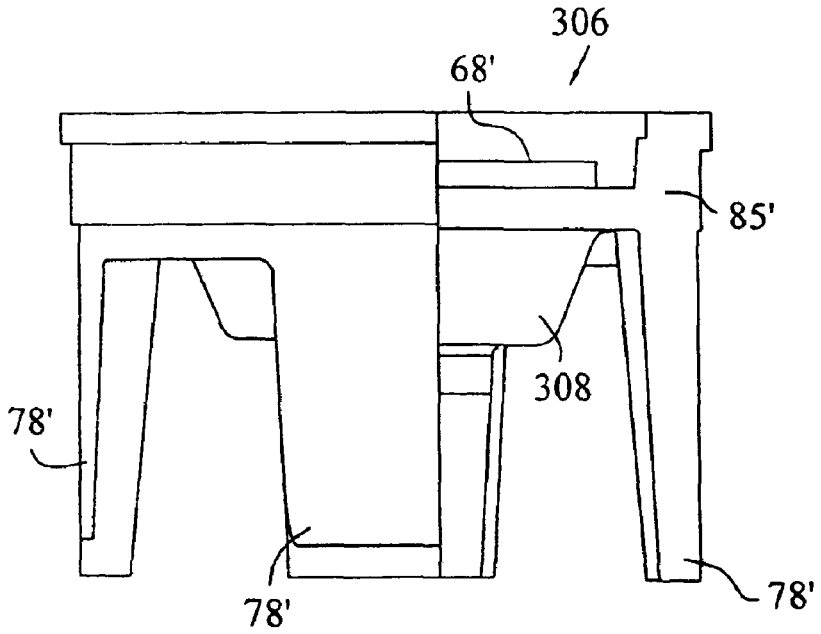
FIG. 13 is a side view of the crankcase of FIG. 10.

Crankcase 62 is shown in FIGS. 5–9. As shown in these Figures, crankcase 62 includes a plurality of legs 78. As can be seen in FIG. 5, legs 78 which are positioned adjacent recess 85 include threaded bores 300 which receive screws 84 for attaching suction baffle 82. In the illustrated embodiment suction baffle 82 is formed out of sheet metal. Other materials may also be used to form suction baffle 82, for example, suction baffle 82 may be formed out of injection molded plastic. Shroud 70 forms a shield portion which defines a partially enclosed space. Shroud 70 defines a partial enclosure which provides a fluid impermeable barrier and, in the illustrated embodiment, only three openings are present in shroud 70, i.e., a first opening 80 defined by thrust surface 68, a second opening 302 defined by cylindrical sleeve 89 and aperture 71 defined by shroud 70. Aperture 71 is open to the interior plenum defined by housing and allows suction pressure refrigerant to enter the partial enclosure defined by shroud 70. The partial enclosure defined by shroud 70 is open to the backside of orbiting scroll 24 via opening 80 and, thus, the backside of orbiting scroll 24 is at suction pressure during operation of compressor 20.

Counterweight 50 rotates within the partial enclosure defined by shroud 70. Openings 80 and 302 are located such that they are both generally centered on the substantially horizontally oriented axis defined by shaft 46. Aperture 71 is disposed above shaft 46 and defines the uppermost portion of crankcase 62. In the illustrated embodiment, shroud 70 extends for approximately 270 degrees about the axis defined by shaft 46 and aperture 71 extends for approximately 90 degrees. The partial enclosure defined by shroud 70 shields oil within sump 58 from the fanning action of counterweight 50 thereby preventing agitation of the oil by such fanning action. If oil is pooled at a height were it might be impacted by rotating counterweight 50, shroud 70 also provides a barrier that prevents oil pooled in the bottom of plenum 39 from being impacted by counterweight 50 as counterweight 50 rotates.

Suction baffle 82 attached to crankcase 62 above aperture 71 diverts incoming refrigerant towards recess 85 and inlet 23 whereby the refrigerant may be compressed between scroll members 22, 24. A portion of the refrigerant entering compressor 20 via intake tube 86 is also directed in the opposite direction towards end cap 168 whereby the refrigerant may cool motor 90. Suction baffle 82 also shields the entering refrigerant from oil slung radially outwardly by rotating shaft 46 and rotating counterweight 50 and thereby acts to minimize the quantity of oil circulated through the refrigeration system.

A second embodiment of a crankcase which can be used with compressor 20 is. shown in FIGS. 10–13. Crankcase 306 is similar to crankcase 62 in that it includes a thrust surface 68', defining an opening 80', legs 78', recess 85' and a sleeve 89' defining an opening 302' these and other features designated with prime reference characters shown in FIGS. 10–13 function in the manner discussed above for crankcase 62. Shroud 308 differs from shroud 70 in that shroud 308 extends for a shorter longitudinal length and counterweight 50 is not located within the partial enclosure defined by shroud 308. Instead, the counterweight used with crankcase 306 is located adjacent sleeve 89 opposite shroud 308. Shroud 308 encircles the compressor shaft for approximately 270 degrees and includes an aperture 310 which extends for an arc of about 90 degrees about the compressor shaft. When assembled, aperture 310 is positioned below the compressor shaft and defines the lowest portion of the shroud 308. By positioning aperture 310 below the compressor shaft, the oil collecting in the partial enclosure defined by shroud 308 by the lubrication of the shaft is allowed to return to sump 58. Both crankcase 62 and crankcase 306 are manufactured by metal casting and subsequent machining of the metal cast parts.

Suction baffle 312 (FIGS. 14–16) or suction baffle 312' (FIGS. 17–21) may be used with crankcase 306. Suction baffle 312 and suction baffle 312' function in the same manner and differ in that suction baffle 312 is configured for use with an inlet tube 86 positioned at location 86*a*, shown in dashed outline in FIG. 2, while suction baffle 312' is configured for use with an inlet tube 86 positioned at location 86*b*, also shown in dashed outline in FIG. 2. Common features of suction baffles 312 and 312' which function in a similar manner have been given common reference characters with those features of suction baffle 312' being designated with a prime reference character.

Figure 14:
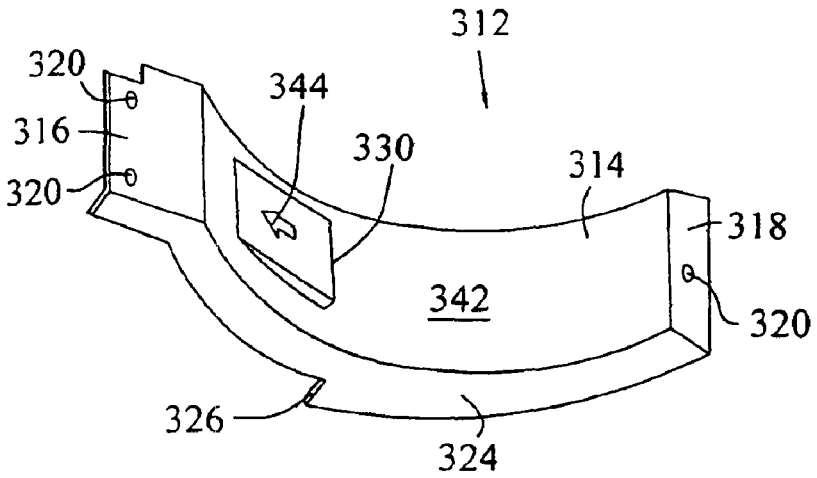
FIG. 14 is perspective view of a suction baffle.
Figure 15:
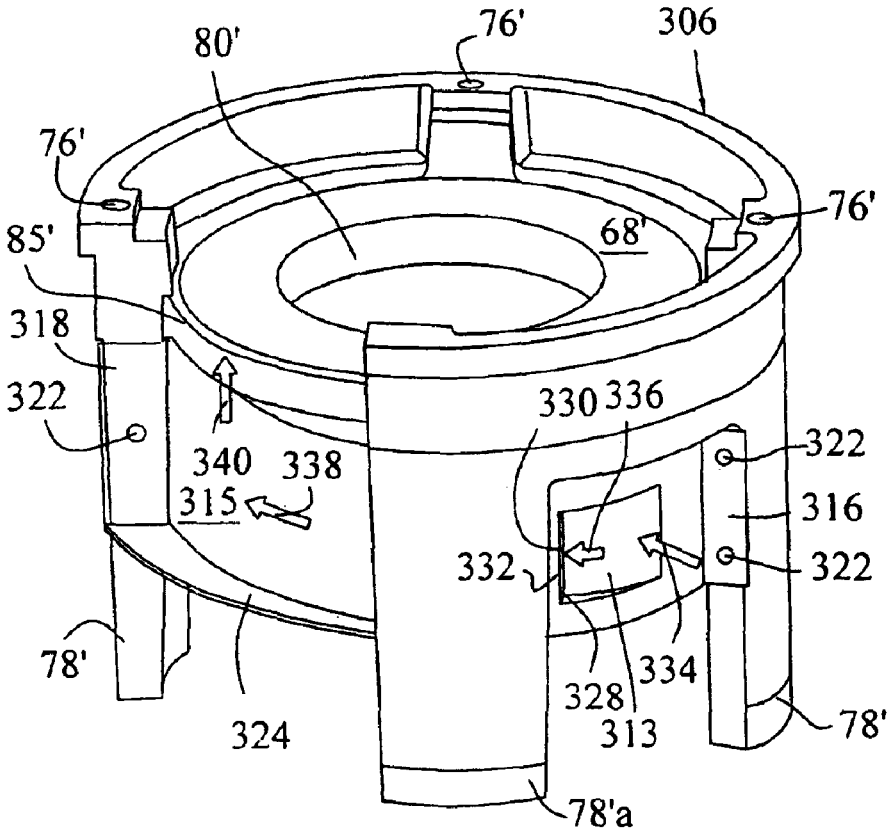
FIG. 15 is a perspective view of crankcase with attached suction baffle.
Figure 16:
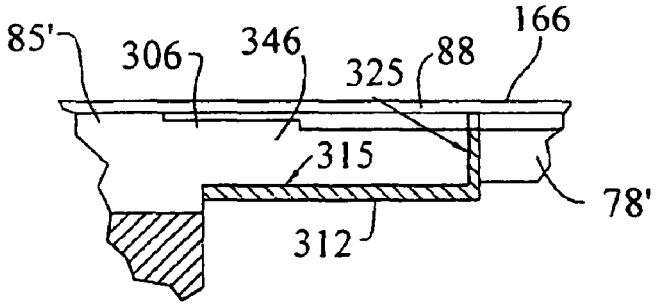
FIG. 16 is partial cross section view of a crankcase and suction baffle of FIG. 15 in a compressor assembly.

Turning first to suction baffle 312 shown in FIGS. 14–16, suction baffle 312 includes a generally arcuate section 314 which has flanges 316 and 318 at its opposite ends. Flanges 316, 318 each include openings 320 through which threaded fasteners 322 may be inserted to secure baffle member 312 to crankcase 306. Suction baffle 312 also includes a lower flange 324 which extends along one edge of arcuate section 314. Lower flange 324 includes a cutout portion 326 which interfits with leg 78*a*' (FIG. 15) of crankcase 306. Arcuate section 314 also includes a baffle opening 328 which has a length substantially greater than its width. First and second edges 330 and 332 run the length of opening 328 and define its width therebetween.

Figure 2:
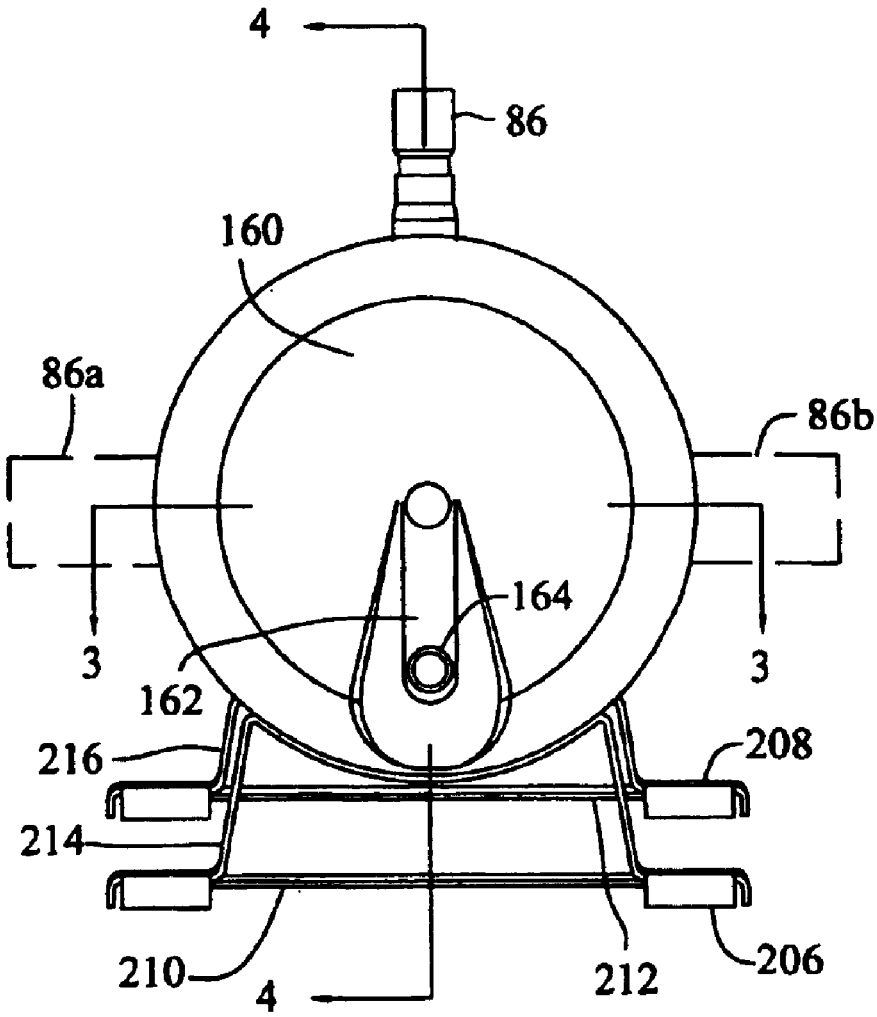
FIG. 2 is an end view of the compressor of FIG. 1.

If crankcase 306 and baffle member 312 are used with compressor 20, inlet tube 86 is repositioned to enter housing 88 at a mid-height level as indicated by dashed outline 86*a* in FIG. 2. Refrigerant entering housing 88 is represented by arrow 334. Arrow 334 together with arrows 336, 338 and 340 represent the flow path of refrigerant from inlet tube 86 to inlet 23 to working space 301 defined between scroll members 22, 24 wherein the refrigerant is compressed. As can be seen in FIG. 15, entering refrigerant, arrow 334, strikes baffle member 312 and is guided by arcuate section 314 and lower flange 324 in the direction shown by arrow 336. The outer surfaces of arcuate section 314 and flange 324 guide the refrigerant and thereby form baffle surfaces 315 and 325. As entering refrigerant strikes baffle surface 315, the oil carried by the refrigerant vapor will tend to collect on baffle surface 315. The refrigerant then flows in the direction of arrow 336 in a generally vertically upward direction and encounters opening 328 which has a length which extends substantially transverse to flow direction 336. The oil on baffle surface 315 will tend to migrate in the direction shown by arrow 336 under the influence of vapor flow. The discontinuity in baffle surface 315 defined by opening 328 functions as an oil stripper, preventing the majority of oil on baffle surface 315 from further migration along surface 315 under the influence of vapor flow. Once oil reaches opening 328 it passes through opening 328 and then migrates downwardly along the rear surface 342 of baffle member 312 in the direction shown by arrow 344 in FIG. 14. Arrow 344 indicates the flow direction of oil under the influence of gravity when baffle member 312 is assembled with compressor 20. Oil separated from the refrigerant by baffle member 312 may return to oil sump 58 under the influence of gravity along rear surface 342 as indicated by arrow 344.

Baffle member 312 is formed out of a sheet-like material and has a first major surface which defines baffle surface 315. The first and second edges 330, 332 of baffle opening 328 define a plane which is positioned at an angle to baffle surface 315 to facilitate the stripping of oil from refrigerant flowing along baffle surface 315. Suction baffle 312' includes a similar baffle opening 328' which is positioned at an angle to baffle surface 315' to facilitate the stripping of oil from refrigerant flowing along baffle surface 315' and the plane defined by first and second edges 330' and 332' corresponds to edge 329' shown in FIG. 18.

Baffle member 312 also defines a depression 313 in baffle surface 315 which precedes the first edge 330 of opening 328 in the direction of refrigerant flow along baffle surface 315. Although in the illustrated embodiment the oil stripping opening 328 generally projects radially inwardly with respect to baffle surface 315, opening 328 could alternatively positioned such as by projecting radially outwardly with respect to baffle surface 315. The configuration of opening 328 may be modified to alter the quantity of refrigerant diverted through opening 328.

Although some refrigerant will enter opening 328 where it may function to cool motor 90, most refrigerant entering housing 88 will follow flow path arrows 336, 338 and 340 along baffle surface 315 and enter the working space of compressor 20 through recess 85. Baffle surface 325 on flange 324 inhibits the flow of refrigerant towards end cap 168. Baffle surface 315 extends from vertically below inlet 86 to recess 85' and together with the interior surface of cylindrical portion 166 of housing 88, baffle surfaces 315 and 325 define a passageway 346 which extends between inlet 86 to housing 88 and inlet 23 to the working space defined between scroll members 22, 24.

Figure 18:
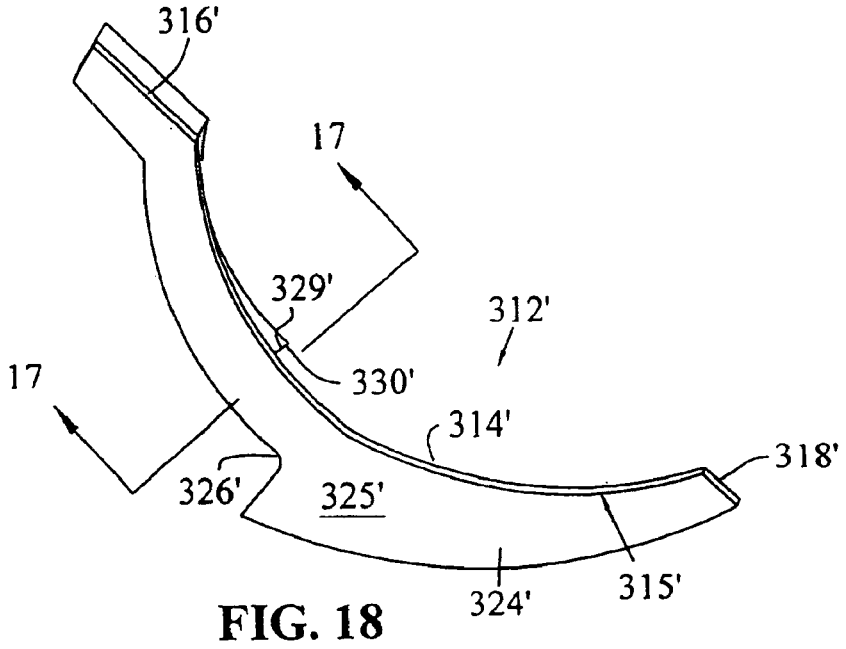
FIG. 18 is an edge view of the suction baffle of FIG. 17.
Figure 19:
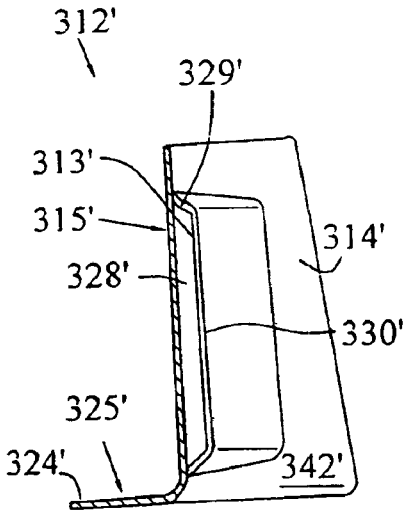
FIG. 19 is a cross sectional view taken along line 19—19 of FIG. 18.
Figure 17:
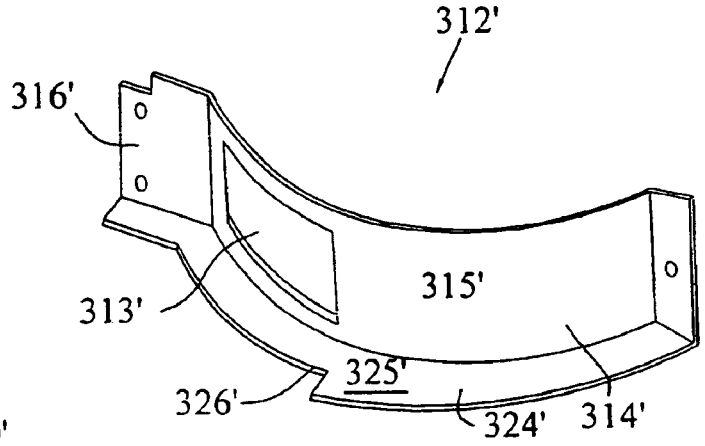
FIG. 17 is a perspective view of another suction baffle.
Figure 20:
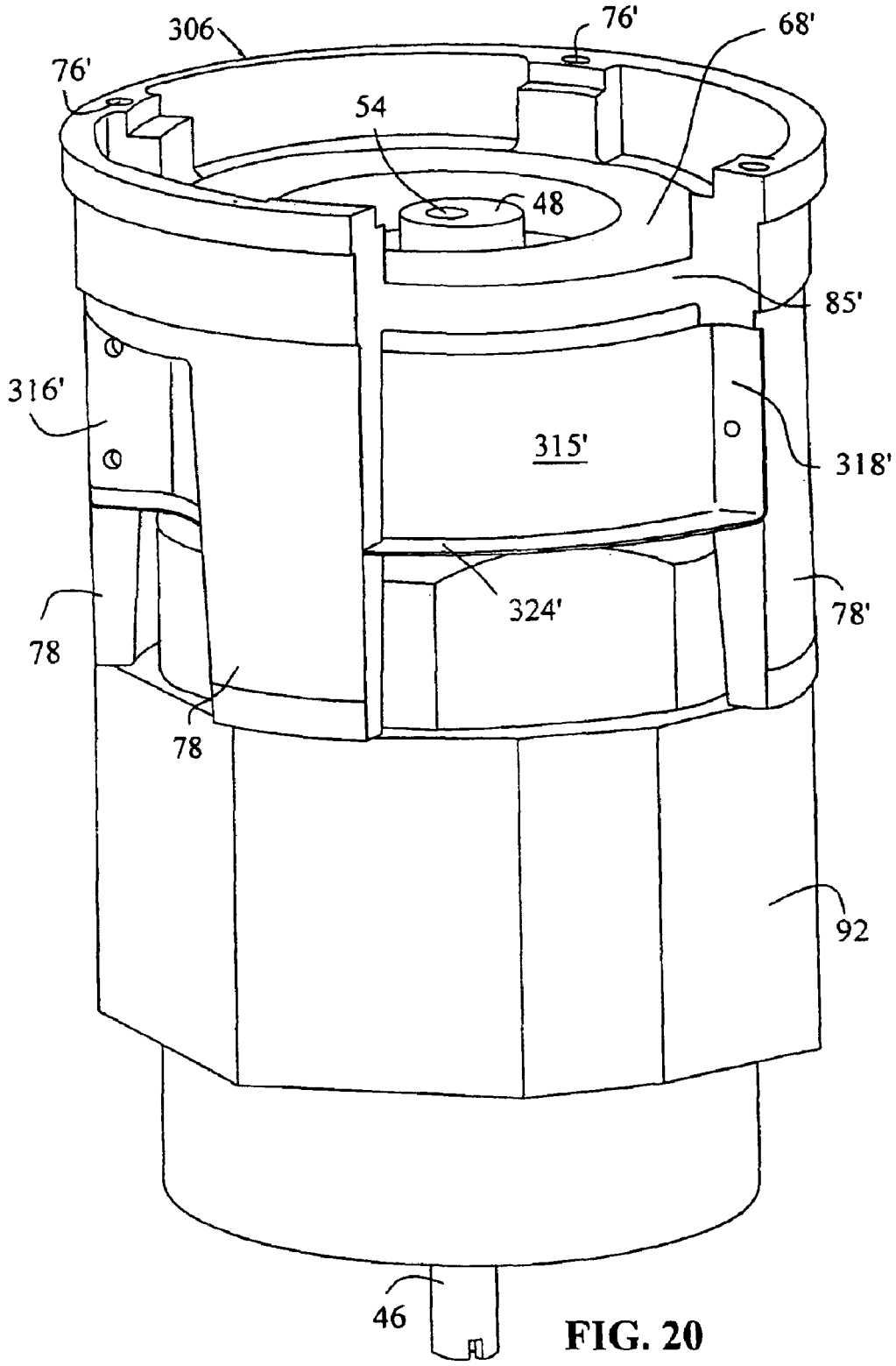
FIG. 20 is a perspective view of the suction baffle of FIG. 17 secured to a crankcase.
Figure 21:
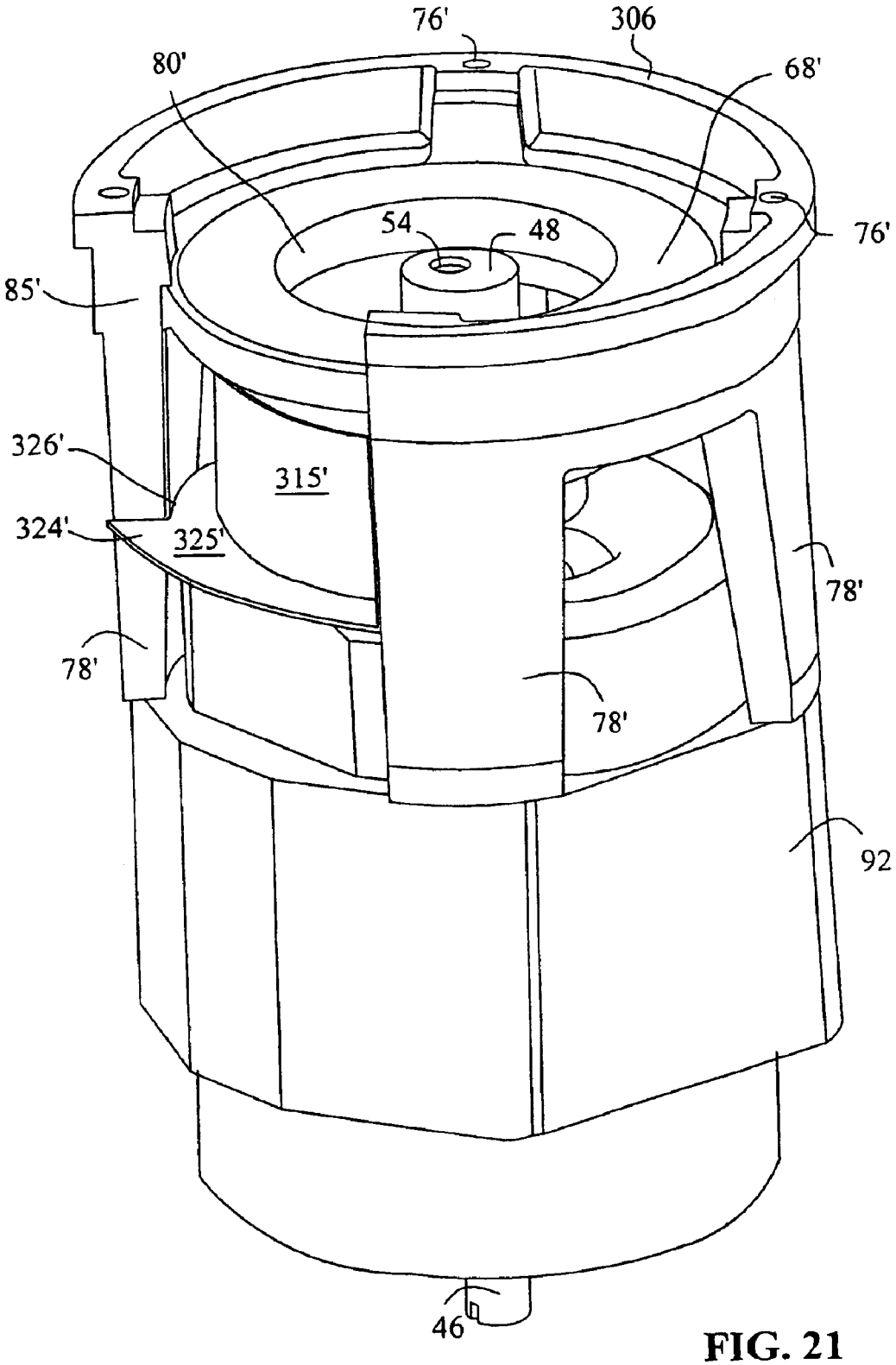
FIG. 21 is another perspective view of the suction baffle of FIG. 17 secured to a crankcase.

FIGS. 17–19 illustrate suction baffle 312' while FIGS. 20 and 21 illustrate suction baffle 312' assembled with crankcase 306. (Fasteners used to secure suction baffle 312' to crankcase 306 are not shown in FIGS. 20 and 21.) Suction baffle 312' directs refrigerant flow and separates oil from the refrigerant vapor in the same manner as described above for suction baffle 312. As discussed above, when baffle member 312' is used with crankcase 306, inlet tube 86 is positioned in the location shown in FIG. 2 as dashed outline 86*b*. It is noted that the perspective view of baffle member 312 shown in FIG. 14 is a view of the generally concave surface 342 of baffle 312 which faces radially inward when baffle 312 is secured to crankcase 306, while the perspective view of baffle member 312' shown in FIG. 17 is a view of the generally convex surface 315' of baffle member 312' which faces radially outward when baffle member 312' is secured to crankcase 306. Similar to suction baffle 82, the illustrated embodiments of suction baffles 312 and 312' may be formed out of bent sheet metal or may be manufactured using other methods such as the injection molding of a plastic material.

A motor 90 is disposed adjacent crankcase 62 and includes a stator 92 and a rotor 94. Bushings 96 are used to properly position stator 92 with respect to crankcase 62 and bearing support 66 when assembling compressor 20. During assembly, crankcase 62, motor 90 and bearing support 66 must have their respective bores through which shaft 46 is inserted precisely aligned. Smooth bore pilot holes 100, 102, 104 which are precisely located relative to these bores are provided in crankcase 62, motor 90 and bearing support 66. Alignment bushings 96 fit tightly within the pilot holes to properly align crankcase 62, motor 90 and bearing support 66. Bolts 98 (FIG. 1) are then used to secure bearing support 66, motor 90 and crankcase 62 together. Pilot holes 100 are located on the distal ends of legs 78 in crankcase 62 and bolts 98 are threaded into engagement with threaded portions of holes 100 when securing crankcase 62, motor 90 and bearing support 66 together. Pilot holes 102 located in stator 92 of motor 90 extend through stator 92 and allow the passage of bolts 98 therethrough. Pilot holes 104 located in bearing support 66 also allow the passage of the shafts of bolts 98 therethrough but prevent the passage of the heads of bolts 98 which bear against bearing support 66 when bolts 98 are engaged with crankcase 62 to thereby secure crankcase 62, motor 90 and bearing support 66 together. In the illustrated embodiment, bushings 96 are hollow sleeves and bolts 98 are inserted through bushings 96. Alternative embodiments, however, could employ pilot holes and bushings to properly align crankcase 62, motor 90 and bearing support 66 with different methods of securing these parts together. For example, the pilot holes could be separate from the openings through which bolts 98 are inserted or alternative methods of securing crankcase 62, motor 90 and bearing support 66 together could be employed with the use of pilot holes and alignment bushings 96. Alignment bushings which may be used with compressor 20 are described by Skinner in U.S. Provisional Patent Application Ser. No. 60/412,868 entitled COMPRESSOR HAVING ALIGNMENT BUSHINGS AND ASSEMBLY METHOD filed on Sep. 23, 2002 which is hereby incorporated herein by reference.

A terminal pin cluster 108 is located on motor 90 and wiring (not shown) connects cluster 108 with a second terminal pin cluster 110 mounted in end cap 168 and through which electrical power is supplied to motor 90. A terminal guard or fence 111 is welded to end cap 168 and surrounds terminal cluster 110. Shaft 46 extends through the bore of rotor 94 and is rotationally secured thereto by a shrink fit whereby rotation of rotor 94 also rotates shaft 46. Rotor 94 includes a counterweight 106 at its end proximate bearing support 66.

As mentioned above, shaft 46 is rotatably supported by ball bearing 64 which is mounted in bearing support 66. Bearing support 66 includes a central boss 112 which defines a substantially cylindrical opening 114 in which ball bearing 64 is mounted. A retaining ring 118 is fitted within a groove 116 located in the interior of opening 114 to retain ball bearing 64 within boss 112. An oil shield 120 is secured to boss 112 and has a cylindrical portion 122 which extends towards motor 90 therefrom. Counterweight 106 is disposed within the space circumscribed by cylindrical portion 122 and is thereby shielded from the oil located in oil sump 58, although it is expected that the oil level 123 will be below oil shield 120 under most circumstances, as shown in FIG. 4. Oil shield 120 is positioned so that it inhibits the impacting of counterweight 106 on oil migrating to oil sump 58 and also inhibits the agitation of oil within oil sump 58 which might be caused by the movement of refrigerant gas created by the rotation of eccentrically positioned counterweight 106. A second substantially cylindrical portion 124 of oil shield 120 has a smaller diameter than the first cylindrical portion 122 and has a plurality of longitudinally extending tabs with radially inwardly bent distal portions. Boss 112 includes a circular groove and oil shield 120 is secured to boss 112 by engaging the radially inwardly bent distal portions with the circular groove. An oil shield which may be used with compressor 20 is described by Skinner in U.S. Provisional Patent Application Ser. No. 60/412,838 entitled COMPRESSOR HAVING COUNTERWEIGHT SHIELD filed on Sep. 23, 2002 which is hereby incorporated herein by reference.

Support arms 134 extend between boss 112 and outer ring 136 of bearing support 66. The outer perimeter of ring 136 is press fit into engagement with housing 88 to secure bearing support 66 therein. The interior perimeter of outer ring 136 faces the windings of stator 92 when bearing support 66 is engaged with motor 90. Flats 138 are located on the outer perimeter of ring 136 and the upper flat 138 facilitates the equalization of pressure within suction plenum by allowing refrigerant to pass between outer ring 136 and housing 88. Flat 138 located along the bottom of ring 136 allows oil in oil sump 58 to pass between ring 136 and housing 88. A notch 140 located on the interior perimeter of outer ring 136 may be used to locate bearing support 66 during machining of bearing support 66 and also facilitates the equalization of pressure within suction plenum 39 by allowing refrigerant to pass between stator 92 and ring 136. The outer perimeter of stator 92 also includes flats to provide passages between stator 92 and housing 88 through which lubricating oil and refrigerant may be communicated.

Support arms 134 are positioned such that the two lowermost arms 134 form an angle of approximately 120 degrees to limit the extent to which the two lowermost arms 134 extend into the oil in sump 58 and thereby limit the displacement of oil within oil sump 58 by such arms 134. A sleeve 142 projects rearwardly from bearing support 66 and provides for uptake of lubricating oil from oil sump 58. An oil pick up tube 144 is secured to sleeve 142 with a threaded fastener 146. An O-ring 148 provides a seal between oil pick up tube 144 and sleeve 142. As shown in FIG. 1, secured within a bore in sleeve and positioned near the end of shaft 46 are vane 150, reversing port plate 152, pin 154, washer and wave spring 156, and retaining ring 158 which facilitate the communication of lubricating oil through sleeve 112. Although appearing as one part in FIG. 1, washer and wave spring 156 are two separate parts wherein the washer is a flat circular part which does not include a central opening while the wave spring is formed from a sheet material and has a circular outer perimeter and central opening and circumferentially extending undulations. Such washers and wave springs are known in the art. A bearing support which may be used with compressor 20 is described by Haller in U.S. Provisional Patent Application Ser. No. 60/412,890 entitled COMPRESSOR HAVING BEARING SUPPORT filed on Sep. 23, 2002 which is hereby incorporated herein by reference. The bearing support may also include one or more circumferentially spaced recesses in the surface of the outer ring which bears against the stator whereby any bulges in the laminations of the stator caused by the securing of the bearing support against the stator may project into the recesses. The use of such recesses is described by Skinner et al. in U.S. patent application Ser. No. 10/617,475 entitled BEARING SUPPORT AND STATOR ASSEMBLY FOR COMPRESSOR which is hereby incorporated herein by reference.

Figure 3:
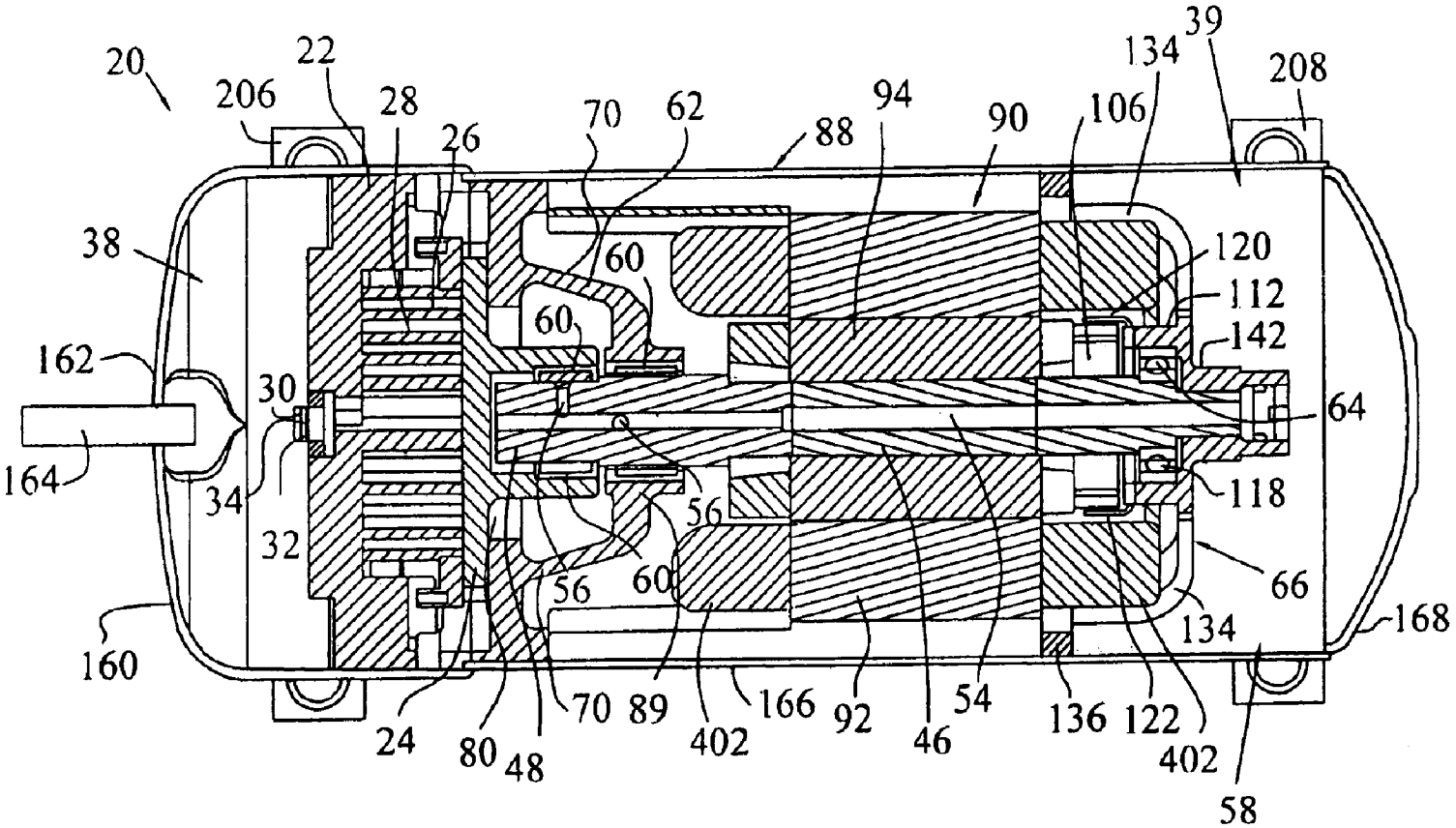
FIG. 3 is a sectional view of the compressor of FIG. 2 taken along line 3—3.

As can be seen in FIGS. 3 and 4, compressor housing 88 includes a discharge end cap 160 having a relatively flat portion 162. Housing 88 also includes a cylindrical shell 166 and rear end cap 168. End caps 160, 168 are welded to cylindrical shell 166 to provide an hermetically sealed enclosure. A discharge tube 164 extends through an opening in flat portion 162. The securement of discharge tube 164 to end cap 160 by welding or brazing is facilitated by the use of flat portion 162 immediately surrounding the opening through which discharge tube 164 is positioned.

After the compressor and motor subassembly is assembled and shrink-fitted into cylindrical housing shell 166, fixed scroll member 22 is positioned within discharge end cap 160 and tightly engages the interior surface of end cap 160. Discharge plenum 38 is formed between discharge end cap 160 and fixed scroll member 22. As compressed refrigerant is discharged through discharge port 30 it enters discharge plenum 38 and is subsequently discharged from compressor 20 through discharge tube 164. Compressed refrigerant carries oil with it as it enters discharge plenum 38. Some of this oil will separate from the refrigerant and accumulate in the bottom portion of discharge plenum 38. Discharge tube 164 is located near the bottom portion of discharge plenum 38 so that the vapor flow discharged through tube 164 will carry with it oil which has settled to the bottom portion of discharge plenum 38 and thereby limit the quantity of oil which can accumulate in discharge plenum 38. Although the illustrated embodiment utilizes a short, straight length of tubing to provide discharge tube 164, alternative embodiments of the discharge outlet may also be used. A discharge plenum configuration which may be used with compressor 20 is described by Skinner in U.S. Provisional Patent Application Ser. No. 60/412,871 entitled COMPRESSOR DISCHARGE ASSEMBLY filed on Sep. 23, 2002 which is hereby incorporated herein by reference.

Mounting brackets 206 and 208 are welded to housing 88 and support compressor 20 in a generally horizontal orientation. As can be seen in FIG. 4, however, mounting brackets 206, 208 have legs which differ in length such that the axis of shaft 46 defined by passage 54 while substantially horizontal will be positioned at an incline. The configuration of brackets 206, 208 are such that the portion of low pressure plenum 39 positioned below bearing support 66 and which defines oil sump 58 will be the lowermost portion of compressor 20. Bottom brace members 210, 212 may be secured to support members 214, 216 (FIG. 2) by a swaging operation. The mounting brackets used with compressor 20 may be those described by Skinner in U.S. Provisional Patent Application Ser. No. 60/412,884 entitled COMPRESSOR MOUNTING BRACKET AND METHOD OF MAKING filed on Sep. 23, 2002 which is hereby incorporated herein by reference. Alternative mounting brackets may also be employed. For example, mounting brackets formed by support members similar to members 214 and 216 but which have been given greater rigidity by bending their outer edges downward along the full length of the support members may be used without a crossbrace to support compressor 20.

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly comprising:

a housing defining an interior plenum and having an inlet opening; a stationary scroll member fixed within said housing;

an orbiting scroll member disposed within said housing and engaged with said stationary scroll member;

an oil sump disposed within said interior plenum;

a shaft rotatable about a shaft axis, said shaft operably coupled with said orbiting scroll member;

a motor operably coupled with said shaft;

a crankcase fixed within said housing and disposed between said orbiting scroll member and said motor, said crankcase having a thrust surface engageable with said orbiting scroll member and defining a first opening, said crankcase including a bearing support portion defining a second opening, said shaft freely extending through said first opening and extending through and bearingly supported at said second opening;

said crankcase having a shield portion extending from proximate said first opening to proximate said second opening and defining a partial enclosure for said shaft between said first opening and said second opening, said shield portion defining an aperture providing fluid communication between said interior plenum and said partial enclosure, said aperture axially extending from proximate said first opening to proximate said second opening, said shield portion circumferentially extending about said shaft through an arc of at least 180 degrees and spaced radially outwardly of said shaft;

a sheet-like baffle member secured to said crankcase and positioned proximate said inlet opening;

wherein said crankcase includes a plurality of legs extending from proximate said thrust surface substantially parallel to said shaft axis and having distal ends engageable with said motor; and said baffle member being secured to at least one of said legs.

2. The compressor assembly of claim 1 further comprising a counterweight disposed on said shaft between said first and second openings within said partial enclosure.

3. The compressor assembly of claim 1 wherein said baffle member is positioned radially outwardly of said aperture.

4. The compressor assembly of claim 1 wherein said shield portion circumferentially extends about said shaft through an arc of at least about 270 degrees.

5. A compressor assembly comprising:

a housing defining an interior plenum and having an inlet opening; a stationary scroll member fixed within said housing;

an orbiting scroll member disposed within said housing and engaged with said stationary scroll member;

an oil sump disposed within said interior plenum;

a shaft rotatable about a shaft axis, said shaft operably coupled with said orbiting scroll member;

a motor operably coupled with said shaft;

a crankcase fixed within said housing and disposed between said orbiting scroll member and said motor, said crankcase having a thrust surface engageable with said orbiting scroll member and defining a first opening, said crankcase including a bearing support portion defining a second opening, said shaft freely extending through said first opening and extending through and bearingly supported at said second opening;

said crankcase having a shield portion extending from proximate said first opening to proximate said second opening and defining a partial enclosure for said shaft between said first opening and said second opening, said shield portion defining an aperture providing fluid communication between said interior plenum and said partial enclosure, said aperture axially extending from proximate said first opening to proximate said second opening, said shield portion circumferentially extending about said shaft through an arc of at least 180 degrees and spaced radially outwardly of said shaft;

a sheet-like baffle member secured to said crankcase and positioned proximate said inlet opening; and wherein said crankcase has an outer perimeter which defines a recess providing access to a working space between said fixed and orbiting scroll members, said baffle member positioned adjacent said recess.

6. A compressor assembly comprising:

a housing defining an interior plenum and having an inlet opening; a stationary scroll member fixed within said housing;

an orbiting scroll member disposed within said housing and engaged with said stationary scroll member;

an oil sump disposed within said interior plenum;

a shaft rotatable about a shaft axis, said shaft operably coupled with said orbiting scroll member, a motor operably coupled with said shaft;

a crankcase fixed within said housing and disposed between said orbiting scroll member and said motor, said crankcase having a thrust surface engageable with said orbiting scroll member and defining a first opening, said crankcase including a bearing support portion defining a second opening, said shaft freely extending through said first opening and extending through and bearingly supported at said second opening;

said crankcase having a shield portion extending from proximate said first opening to proximate said second opening and defining a partial enclosure for said shaft between said first opening and said second opening, said shield portion defining an aperture positioned at a height above said shaft axis and providing fluid communication between said interior plenum and said partial enclosure, said aperture axially extending from proximate said first opening to proximate said second opening, said shield portion circumferentially extending about said shaft through an arc of at least 180 degrees and spaced radially outwardly of said shaft; and a sheet-like baffle member secured to said crankcase and positioned proximate said inlet opening.

7. A compressor assembly comprising:

a housing defining an interior plenum;

a stationary scroll member fixed within said housing;

an orbiting scroll member disposed within said housing and engaged with said stationary scroll member;

a shaft rotatable about a shaft axis, said shaft operably coupled with said orbiting scroll member;

a motor operably coupled with said shaft;

a crankcase disposed between said motor and said orbiting scroll member, said crankcase having a thrust surface engageable with said orbiting scroll member and defining a first opening, said crankcase including a bearing support portion defining a second opening, said shaft extending freely through said first opening and extending through and bearingly supported at said second opening, said crankcase including a plurality of legs extending from proximate said thrust surface in a direction substantially parallel to said shaft axis and having distal ends engageable with said motor, said crankcase having a shield portion extending from proximate said first opening to proximate said second opening and defining a partial enclosure for said shaft between said first opening and said second opening, said shield portion defining an aperture providing fluid communication between said interior plenum and said partial enclosure, said aperture axially extending from proximate said first opening to proximate said second opening, said shield portion circumferentially extending about said shaft along an arc of at least 180 degrees and spaced radially outwardly of said shaft and radially inwardly of said plurality of legs; and a baffle member secured to said crankcase and at least partially disposed radially between said shield portion and said legs.

8. The compressor assembly of claim 7 further comprising a counterweight disposed on said shaft between said first and second openings within said partial enclosure.

9. The compressor assembly of claim 7 wherein said baffle member is positioned radially outwardly of said aperture.

10. The compressor assembly of claim 7 wherein said crankcase has an outer perimeter which defines a recess providing access to a working space between said fixed and orbiting scroll members, said baffle member positioned adjacent said recess.

11. The compressor assembly of claim 7 wherein said aperture is positioned at a height above said shaft axis.

12. The compressor assembly of claim 7 wherein said shield portion circumferentially extends about said shaft through an arc of at least about 270 degrees.

13. A compressor assembly comprising:

a housing defining an interior plenum and having an inlet opening;

a stationary scroll member fixed within said housing;

an orbiting scroll member disposed within said housing and engaged with said stationary scroll member;

an oil sump disposed within said interior plenum;

a shaft rotatable about a shaft axis, said shaft operably coupled with said orbiting scroll member;

a motor operably coupled with said shaft;

a crankcase fixed within said housing and disposed between said orbiting scroll member and said motor, said crankcase having a thrust surface engageable with said orbiting scroll member and defining a first opening, said crankcase including a bearing support portion defining a second opening, said shaft freely extending through said first opening and extending through and bearingly supported at said second opening;

said crankcase having a shield portion extending from proximate said first opening to proximate said second opening and defining a partial enclosure for said shaft between said first opening and said second opening, said shield portion defining an aperture providing fluid communication between said interior plenum and said partial enclosure, said aperture positioned at a height above said shaft axis, said aperture substantially aligned with said inlet opening and axially extending from proximate said first opening to proximate said second opening, said shield portion circumferentially extending about said shaft through an arc of at least 180 degrees and spaced radially outwardly of said shaft; and a baffle member secured to said crankcase over said aperture and positioned proximate said inlet opening.

14. A compressor assembly comprising:

a housing defining an interior plenum and having an inlet opening; a stationary scroll member fixed within said housing;

an orbiting scroll member disposed within said housing and engaged with said stationary scroll member;

an oil sump disposed within said interior plenum;

a shaft rotatable about a shaft axis, said shaft operably coupled with said orbiting scroll member;

a motor operably coupled with said shaft;

a crankcase fixed within said housing and disposed between said orbiting scroll member and said motor, said crankcase having a thrust surface engageable with said orbiting scroll member and defining a first opening, said crankcase including a bearing support portion defining a second opening, said shaft freely extending through said first opening and extending through and bearingly supported at said second opening;

said crankcase having a shield portion extending from proximate said first opening to proximate said second opening and defining a partial enclosure for said shaft between said first opening and said second opening, said shield portion defining an aperture providing fluid communication between said interior plenum and said partial enclosure, said aperture positioned at a height above said shaft axis, said aperture axially extending from proximate said first opening to proximate said second opening, said shield portion circumferentially extending about said shaft through an arc of at least 180 degrees and spaced radially outwardly of said shaft; and a baffle member secured to said crankcase and positioned proximate said inlet opening, at least a portion of said baffle member positioned within said aperture.

* * * * *